US008315862B2

(12) United States Patent
Kim et al.

(10) Patent No.: US 8,315,862 B2
(45) Date of Patent: Nov. 20, 2012

(54) AUDIO SIGNAL QUALITY ENHANCEMENT APPARATUS AND METHOD

(75) Inventors: Jung Hoe Kim, Seongnam-si (KR); Ho Chong Park, Seongnam-si (KR); Eun Mi Oh, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 735 days.

(21) Appl. No.: 12/479,009

(22) Filed: Jun. 5, 2009

(65) Prior Publication Data

US 2009/0306971 A1 Dec. 10, 2009

(30) Foreign Application Priority Data

Jun. 9, 2008 (KR) ..... 10-2008-0053695

(51) Int. Cl.

| | |
|---|---|
| ***G10L 11/00*** | (2006.01) |
| ***G10L 19/02*** | (2006.01) |
| ***G10L 19/14*** | (2006.01) |
| ***G10L 11/04*** | (2006.01) |
| ***G10L 11/06*** | (2006.01) |
| ***G10L 21/02*** | (2006.01) |

(52) U.S. Cl. ..... 704/226; 704/200; 704/203; 704/205; 704/207; 704/208; 704/211; 704/214; 704/225; 704/227; 704/228

(58) Field of Classification Search ..... 704/200, 704/203, 205, 207, 208, 211, 214, 225–228
See application file for complete search history.

(56) References Cited

U.S. PATENT DOCUMENTS

| | | | | |
|---|---|---|---|---|
| 5,842,162 | A * | 11/1998 | Fineberg | 704/233 |
| 5,901,234 | A * | 5/1999 | Sonohara et al. | 381/104 |
| 6,266,632 | B1 * | 7/2001 | Kato et al. | 704/219 |
| 6,453,289 | B1 * | 9/2002 | Ertem et al. | 704/225 |
| 6,671,667 | B1 * | 12/2003 | Chandran et al. | 704/233 |
| 6,852,567 | B1 * | 2/2005 | Lee et al. | 438/106 |
| 7,152,032 | B2 * | 12/2006 | Suzuki et al. | 704/262 |
| 7,286,980 | B2 * | 10/2007 | Wang et al. | 704/205 |
| 7,469,208 | B1 * | 12/2008 | Kincaid | 704/224 |
| 7,949,520 | B2 * | 5/2011 | Nongpiur et al. | 704/207 |
| 8,019,095 | B2 * | 9/2011 | Seefeldt et al. | 381/107 |
| 8,170,870 | B2 * | 5/2012 | Kemmochi et al. | 704/207 |
| 2004/0030546 | A1 * | 2/2004 | Sato | 704/207 |

(Continued)

OTHER PUBLICATIONS

Juin-Hwey Chen; Gersho, A.; , "Adaptive postfiltering for quality enhancement of coded speech," Speech and Audio Processing, IEEE Transactions on , vol. 3, No. 1, pp. 59-71, Jan. 1995.*
Breen, Mara. The identification and function of English prosodic feature. Massachusetts Institute of Technology, Abstract, 2007.*

*Primary Examiner* — Paras D Shah
(74) *Attorney, Agent, or Firm* — Stanzione & Kim, LLP

(57) ABSTRACT

An audio signal quality enhancement apparatus and method. The apparatus includes a pitch calculating unit to extract a pitch period of an audio signal, a frequency domain transforming unit to transform the audio signal to a frequency domain, a frequency band dividing unit to classify the transformed audio signal into audio signals for each of the plurality of frequency bands based on the extracted pitch period, and a pitch enhancement unit to determine a gain based on a volume of the transformed audio signal, and to generate an output signal by multiplying each of the classified audio signals with respect to each of the plurality of frequency bands by the gain, thereby enhancing quality of the audio signal.

21 Claims, 13 Drawing Sheets

U.S. PATENT DOCUMENTS

2005/0165603 A1 7/2005 Bessette et al.
2005/0240401 A1* 10/2005 Ebenezer ..... 704/226
2006/0080087 A1* 4/2006 Vandali et al. ..... 704/207

* cited by examiner

AUDIO SIGNAL QUALITY ENHANCEMENT APPARATUS AND METHOD

CROSS-REFERENCE TO RELATED APPLICATIONS

This application claims the benefit of Korean Patent Application No. 10-2008-0053695, filed on Jun. 9, 2008, in the Korean Intellectual Property Office, the disclosure of which is incorporated herein by reference.

BACKGROUND

1. Field of the Invention

Example embodiments relate to an audio signal quality enhancement apparatus and a method thereof, and more particularly, to an apparatus and method of enhancing quality of an audio signal in an environment incurring a large amount of noise.

2. Description of the Related Art

A user may conveniently communicate with others away from the user's location using a mobile terminal due to development of a wireless communication technology. Since the user of the mobile terminal may communicate in various environments, a quality of voice communication that the user experiences may be affected by a surrounding environment. Noise from the surrounding environment may be a factor that affects the quality of voice communication.

When it is difficult for the user to understand a voice of a person being communicated with because noise from the surrounding environment is loud, the user generally increases a volume of a speaker. In this instance, when the volume of the speaker is increased, a volume of noise is also increased as well as volume of a voice signal, and thus an effect of quality enhancement may relatively low.

Accordingly, a major subject of enhancing the quality of voice communication is to increase the volume of the voice signal, and also to improve a Signal to Noise Ratio (SNR).

Improvement has been attempted through use of a filter that improves a major frequency band which plays an important role in an intelligibility of the voice signal. Particularly, when the intelligibility decreases due to signal loss during compression/decompression, a compensation process with respect to the loss signal is required.

Also, processing a signal in a time domain and transforming a signal into a frequency domain to process the signal in a frequency domain are combined with a digital communication technology in a voice signal processing.

SUMMARY

According to an example embodiment, there may be provided an apparatus including a pitch calculating unit to extract a pitch period of an audio signal, a frequency domain transforming unit to transform the audio signal to a frequency domain, a frequency band dividing unit to divide an entire frequency band into a plurality of frequency bands based on the extracted pitch period, and to classify the transformed audio signal into audio signals for each of the plurality of frequency bands, and a pitch enhancement unit to determine a gain based on a volume of the transformed audio signal, and to generate an output signal by multiplying each of the classified audio signals with respect to each of the plurality of frequency bands by the gain.

According to another example embodiment, there may also be provided an apparatus including a frequency domain transforming unit to transform an audio signal to a frequency domain, a frequency band dividing unit to classify the transformed audio signal into audio signals for each of a plurality of frequency bands, a time domain transforming unit to transform each of the classified audio signals into a time domain, and a temporal envelope enhancement unit to determine a gain based on a variation of the audio signal over time, the audio signal being transformed to the time domain, and to generate an output signal for each of the plurality of frequency bands by multiplying the audio signal transformed into the time domain by the gain.

According to still another example embodiment, there may also be provided a signal quality enhancement method, the method including extracting a pitch period of an audio signal, transforming the audio signal to a frequency domain, classifying the transformed audio signal into audio signals for each of a plurality of frequency bands based on the extracted pitch period, determining a gain based on a volume of each of the classified audio signals, and generating an output signal by multiplying each of the audio signals classified with respect to each of the plurality of frequency bands by the gain.

According to yet another example embodiment, there may also be provided a signal quality enhancement method, the method including transforming an audio signal to a frequency domain, classifying the audio signal transformed to the frequency domain into audio signals for each of a plurality of frequency bands, transforming each of the classified audio signals into a time domain, determining a gain based on variation of the audio signal over time, the audio signal being transformed into the time domain, and generating an output signal for each frequency band by multiplying the audio signal transformed into the time domain by the gain. Additional aspects, features, and/or advantages of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of example embodiments will become apparent and more readily appreciated from the following description, taken in conjunction with the accompanying drawings of which.

DETAILED DESCRIPTION OF THE EMBODIMENTS

Figure 1:
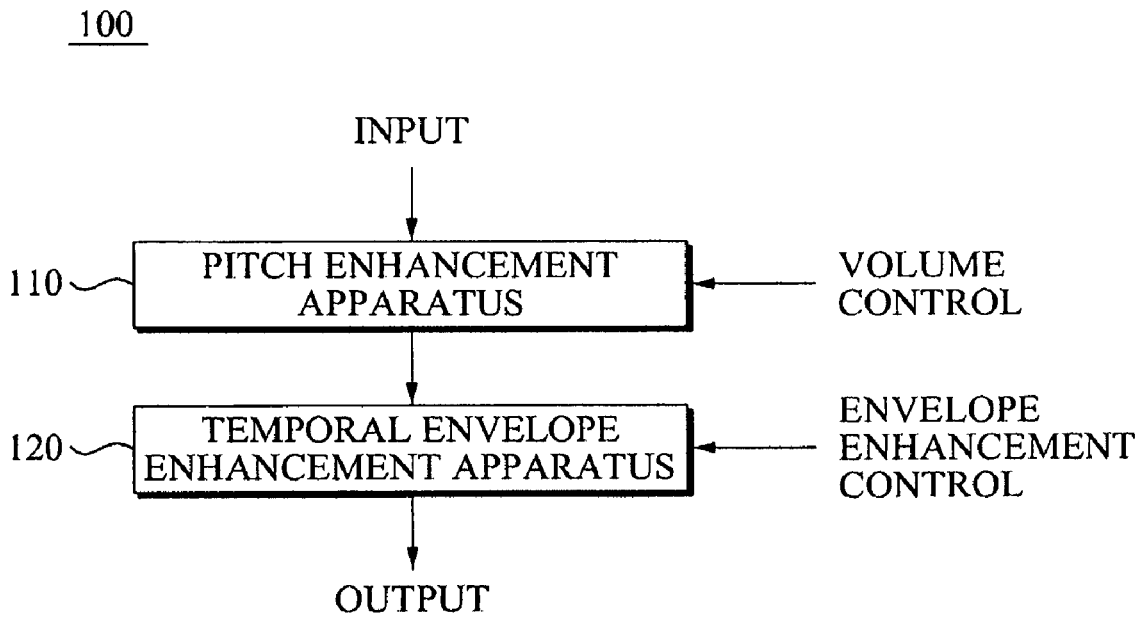
FIG. 1 illustrates an apparatus according to an example embodiment.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 illustrates an apparatus 100 according to the present example embodiment.

Referring to FIG. 1, the apparatus 100 may include a pitch enhancement apparatus 110 and a temporal envelope enhancement apparatus 120.

The pitch enhancement apparatus 110 may receive an audio signal as an input signal, generate a pitch-enhanced audio signal according to an inputted volume control signal, and transmit the generated pitch-enhanced audio signal to the temporal envelope enhancement apparatus 120.

The temporal envelope enhancement apparatus 120 may receive the pitch-enhanced audio signal from the pitch enhancement apparatus 110 and generate an output signal according to an inputted envelope enhancement control signal.

Examples of the audio signal processed by the apparatus 100 may include a music signal or a sound effect signal, and the like, in addition to a voice signal of a human.

The apparatus 100 of the present example embodiment may be applied to a portable mobile communication terminal, thereby enhancing quality of a voice signal of a human during communication. Also, the apparatus 100 according to the present example embodiment may be applied to an audio terminal or mp3 player, thereby enhancing quality of a music signal or a sound effect signal.

Figure 2:
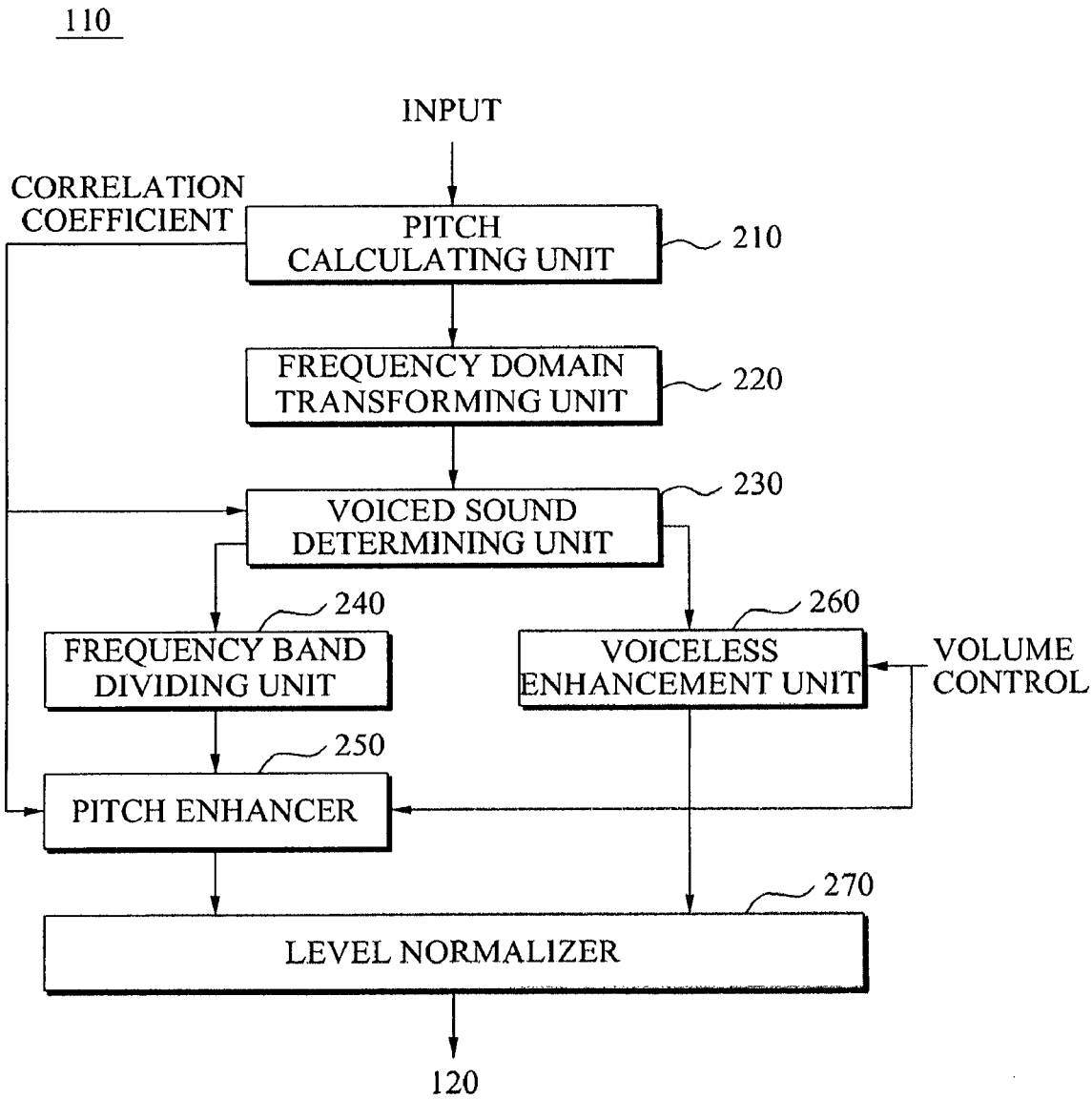
FIG. 2 illustrates an example of a pitch enhancement apparatus of FIG. 1.

FIG. 2 illustrates an example of the pitch enhancement apparatus 100 of FIG. 1.

Referring to FIG. 2, the pitch enhancement apparatus 110 may include a pitch calculating unit 210, a frequency domain transforming unit 220, a voice sound determining unit 230, a frequency band dividing unit 240, and a pitch enhancement unit 250, and may further include a voiceless sound enhancement unit 260 and a level normalizer 270.

The pitch enhancement apparatus 110 according to the present example embodiment may be applied to a portable mobile communication terminal. In this instance, the pitch enhancement apparatus 110 may enhance a pitch of a human voice signal received during communication.

The pitch calculating unit 210 may extract a pitch period of the received voice signal. The pitch calculating unit 210 may calculate a correlation coefficient of the received voice signal. The pitch calculating unit 210 may calculate the pitch period of the received voice signal based on the calculated correlation coefficient.

The frequency domain transforming unit 220 may transform the received voice signal into a frequency domain. The frequency domain transforming unit 220 may transform the received voice signal expressed in a time domain through a Fourier Transform, a Fast Fourier Transform, or a Digital Fourier Transform, and the like into a format expressible in a frequency domain.

The voice sound determining unit 230 may determine whether the received sound signal is a voice sound or a voiceless sound to classify the voice signal transformed into the frequency domain into a voice sound signal according to whether the voice signal is the voice sound. When the pitch calculating unit 210 calculates the pitch period of the received voice signal, the voice sound determining unit 230 may determine whether the received voice signal is a voice sound or a voiceless sound based on a calculation result of the pitch calculating unit 210. When the received voice signal has a pitch component as a result of the calculating of the pitch calculating unit 210, the voice sound determining unit 230 may determine the received sound signal as the voice sound.

According to the present example embodiment, when an audio signal processed by the pitch enhancement apparatus 110 is not a human voice signal, the pitch calculating unit 210 and voice sound determining unit 230 may calculate a pitch of an inputted audio signal and determine whether the input audio signal is a signal with a pitch or a signal without a pitch based on the calculated pitch. When the inputted audio signal is the signal with the pitch, the voice sound determining unit 230 may process the inputted audio signal in the same manner as the voice sound signal.

The pitch calculating unit 210 may divide the received voice signal into time frames, and calculate a pitch period of each of the divided time frames. The voice sound determining unit 230 may distinguish a voice sound frame from a voiceless frame with respect to each of the divided time frames based on the calculated pitch period.

The frequency band dividing unit 240 may divide an entire frequency band into a plurality of frequency bands based on the extracted pitch period. The frequency band dividing unit 240 may classify the voice sound signal of the voice signal transformed to the frequency domain into voice sound signals for each of the plurality of frequency bands. For example, when the pitch period is f0, the frequency band dividing unit 240 may classify the voice signal transformed to the frequency domain using frequency bands, such as [0.5×f0, 1,5×f0], [1.5×f0, 2.5×f0], and the like.

The pitch enhancement unit 250 may determine a gain based on a volume of each of the classified voice signals. The enhancement unit 250 generates a pitch-enhanced voice signal by multiplying each of voice signals classified with the gain with respect to the plurality of frequency bands.

Figure 3:
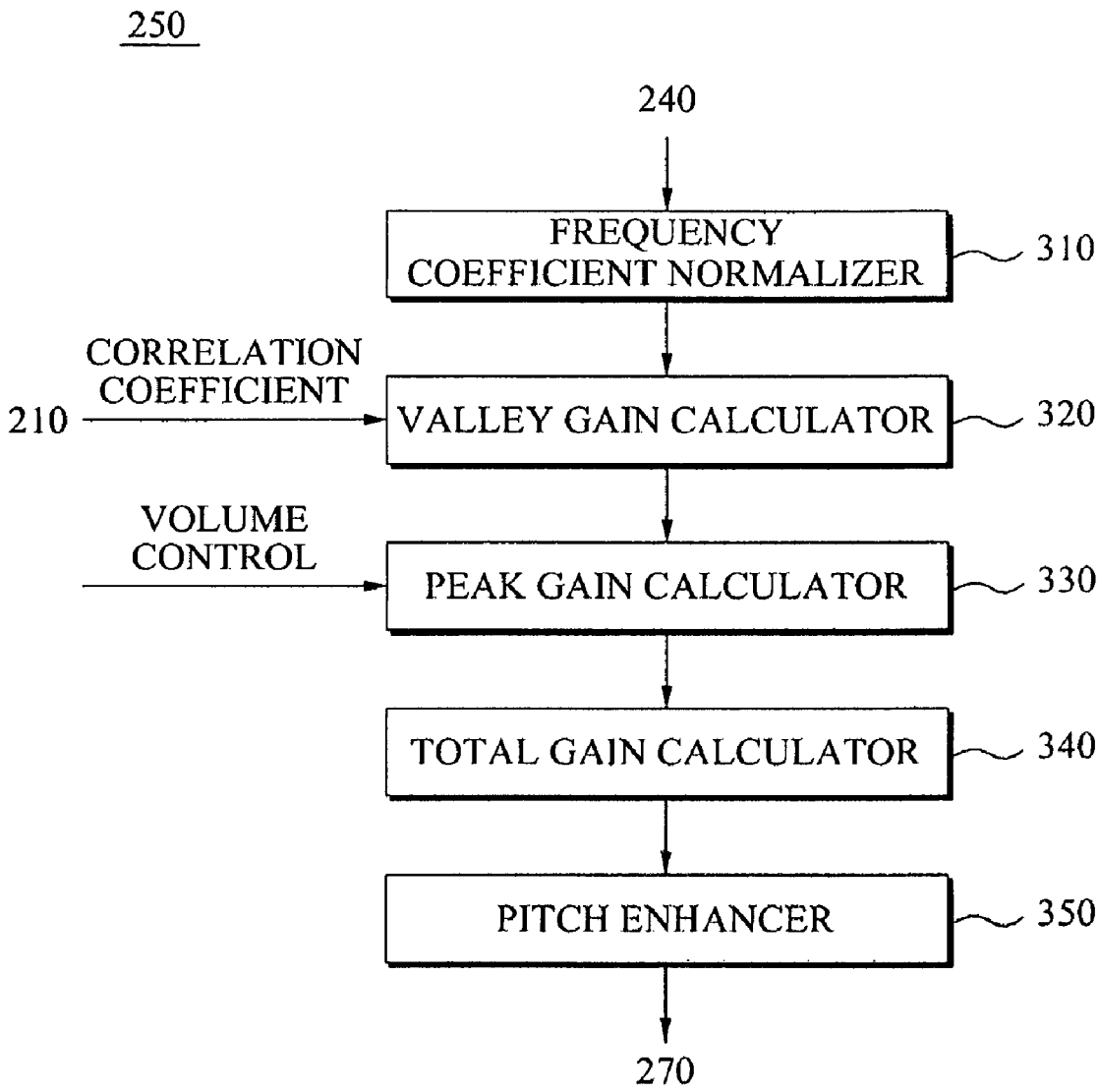
FIG. 3 illustrates an example of a pitch enhancement unit of FIG. 2.

FIG. 3 illustrates an example of the pitch enhancement unit 250 of FIG. 2.

Referring to FIG. 3, the pitch enhancement unit 250 may include a frequency coefficient normalizer 310, a valley gain calculator 320, a peak gain calculator 330, a total gain calculator 340, and a pitch enhancer 350.

With respect to each of the plurality of frequency bands, the frequency coefficient normalizer 310 may normalize frequency coefficients of each of the plurality of frequency bands. When a voice signal is transformed using a Digital Fourier Transform, a discrete frequency coefficient may be obtained as a result. Each discrete frequency coefficient indicates a volume of the voice signal in a frequency.

When an index of the divided frequency band is b, a $k^{th}$ frequency coefficient from among frequency coefficients included in a $b^{th}$ band may be expressed as X[b][k]. The frequency coefficient normalizer 310 calculates a maximum value and a minimum value of the frequency coefficients included in the $b^{th}$ band and normalizes each of the frequency coefficients included in the $b^{th}$ band based on the maximum value and the minimum value. When the maximum value and the minimum value of the frequency coefficients included in the $b^{th}$ band are respectively expressed as max [b] and min [b], a normalized frequency coefficient Xr[b][k] is expressed as Equation 1 below.

$$Xr[b][k] = \frac{\log\frac{X[b][k]}{\min[b]}}{\log\frac{\max[b]}{\min[b]}} \quad \text{[Expression 1]}$$

In this instance, Xr[b][k] may be equal to or greater than 0 and equal to or less than 1.

According to the present example embodiment, the pitch enhancement unit 250 may divide each of the classified voice signals into a pitch peak area, an intermediate area, and a pitch valley area based on the volume of the classified voice signal. In this instance, the pitch enhancement unit 250 may determine an area of each of the classified voice signal using the normalized frequency coefficient. For example, when the normalized frequency coefficient Xr[b][k] is equal to or greater than 0.8 and equal to or less than 1, the pitch enhancement unit 250 may assign the normalized frequency coefficient to the pitch peak area. When the normalized frequency coefficient Xr[b][k] is equal to or greater than 0 and equal to or less than 0.6, the pitch enhancement unit 250 may assign the normalized frequency coefficient to the pitch valley area. When the normalized frequency coefficient Xr[b][k] is equal to or greater than 0.6 and equal to or less than 0.8, the pitch enhancement unit 250 may assign the normalized frequency coefficient to the intermediate area.

The valley gain calculator 320 may receive a correlation coefficient from the pitch calculator 210, and determine gains of normalized frequency coefficients assigned to the pitch valley area based on the received correlation coefficient. For convenience of description, the gain of the normalized frequency coefficients assigned to the pitch valley area is referred to as a valley gain.

Figure 6:
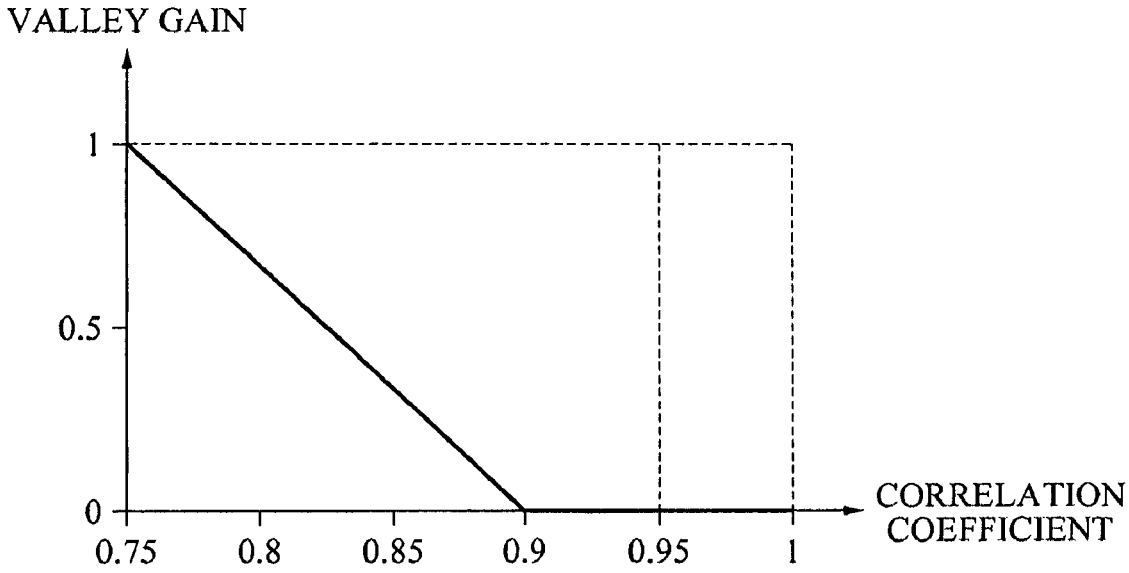
FIG. 6 illustrates an example of an operation of a valley gain calculator of FIG. 3.

FIG. 6 illustrates an example of an operation of the valley gain calculator 320 of FIG. 3.

Referring to FIG. 6, a relation between a correlation coefficient and a valley gain is illustrated. The valley gain calculator 320 may determine a valley gain of a frequency band having a correlation coefficient greater than 0.9 as 0.001. The valley gain calculator 320 may determine a valley gain of a frequency band having a correlation coefficient equal to or greater than 0.75 and equal to or less than 0.9 to be in inverse proportion to the correlation coefficient.

Referring again to FIG. 3, the valley gain calculator 320 may determine a valley gain according to a frequency band. For example, the valley gain calculator 320 may determine a valley gain from a first frequency band to a $b1^{th}$ frequency band as 0.001. In this instance, the valley gain calculator 320 may determine a valley gain L[b] of the $b^{th}$ frequency band as given in Equation 2 below.

$$L[b]=0.001(1\leqq b\leqq b1) \quad \text{[Equation 2]}$$

The valley gain calculator 320 may determine a valley gain of a frequency band having an index equal to or greater than b2 as 1 or a value near 1. For example, the valley gain calculator 320 may determine a valley gain L[b] of a $b^{th}$ frequency band as given in Equation 3 below.

$$L[b]=1(b\geqq b2) \quad \text{[Equation 3]}$$

The valley gain calculator 320 may determine a valley gain L[b] of a $b^{th}$(b1<b<b2) frequency band as given in Equation 4 below.

$$L[b]=L[b-1]+(1.0-L[b-1])/2(b1<b<b2) \quad \text{[Equation 4]}$$

In this instance, the $b1^{th}$ frequency band corresponds to a frequency lower than 3 kHz, and $b2^{th}$ frequency band corresponds to a frequency higher than 3 kHz.

The valley gain calculator 320 may adjust a degree of enhancing a pitch through adjusting the valley gain according to the frequency band. The valley gain calculator 320 may enhance the lowest two formants or the lowest three formants.

The valley gain calculator 320 may determine the valley gain based on an intensity of a pitch of a received voice signal. The valley gain calculator 320 may increase the degree of enhancing the pitch through setting a lower valley gain as the intensity of the pitch of the received voice signal increase.

The peak gain calculator 330 may receive a volume control signal and determine a gain with respect to a normalized frequency coefficient assigned to a pitch peak area. For convenience of description, the gain of the normalized frequency coefficient assigned to the pitch peak area is referred to as a peak gain.

The peak gain calculator 330 may determine a peak gain U[b] of a $b^{th}$ band in a steady state as 1.0. When a volume increases, the peak gain calculator 330 may increase the peak gain in response to a volume control signal, and when a volume decreases, the peak gain calculator 330 may decrease the peak gain in response to a volume control signal.

The pitch enhancement unit 250 may change the peak gain in response to the volume control signal but may not change the valley gain. The pitch enhancement 250 may regularly maintain energy of a signal included in a frequency band so as to regularly maintain a degree of improvement of intelligibility, even when a volume changes. The pitch enhancement 250 may adaptively improve the intelligibility in response to the volume control signal.

The pitch enhancement unit 250 may determine the gain to enable a ratio of the peak gain to the valley gain to decrease as a frequency of the frequency band increase. For example, U[1]/L[1]=1000, and U[10]/U[10]=10.

The total gain calculator 340 may determine a gain of an intermediate area based on the peak gain and valley gain of the frequency band.

Figure 5:
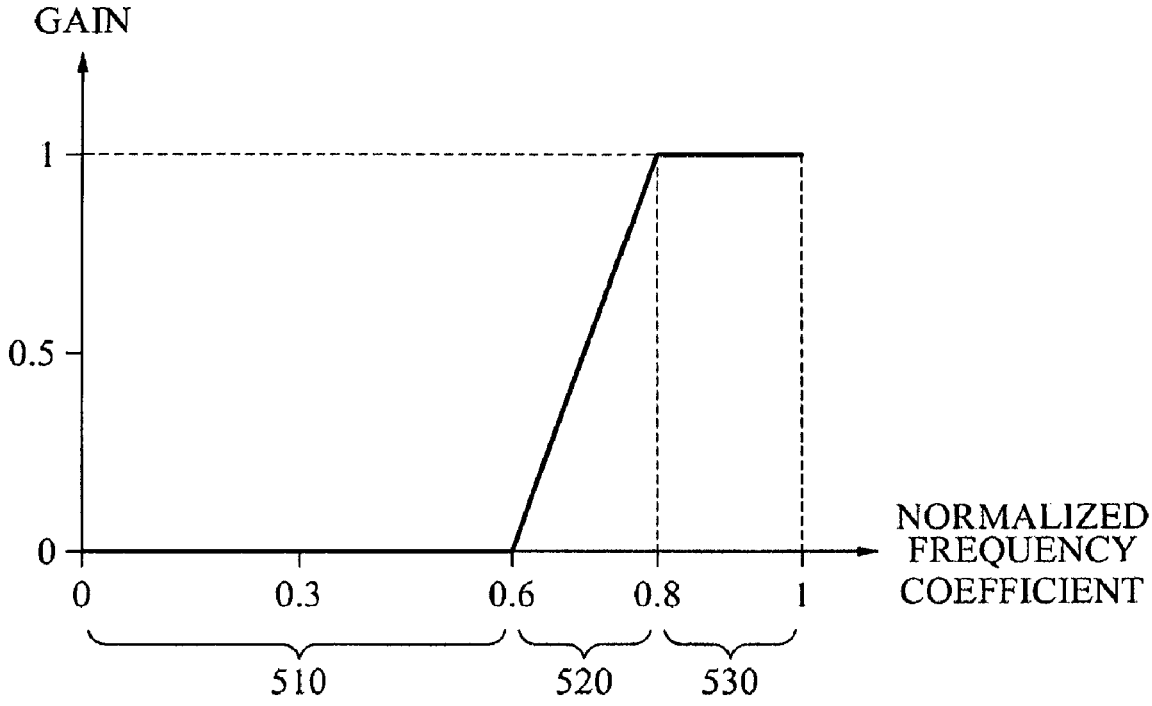
FIG. 5 illustrates an example of an operation of a total gain calculator of FIG. 3.

FIG. 5 illustrates an example of an operation of the total gain calculator 340 of FIG. 3.

Referring to FIG. 5, a relation between a normalized frequency coefficient and a gain is illustrated.

A pitch enhancement unit 250 may assign, to a valley area 510, a normalized frequency coefficient volume of which is equal to or greater than 0 and equal to or less than 1. The valley gain calculator 320 may determine a valley gain of the valley area 510 as 0.001.

The pitch enhancement unit 250 may assign, to a peak area 530, a normalized frequency coefficient volume of which is equal to or greater than 0.8 to equal to or less than 1.0. The peak gain calculator 330 may determine a peak gain of the peak area 530 as 1.0.

The pitch enhancement unit 250 may assign, to an intermediate area 520, a normalized frequency coefficient volume of which is equal to or greater than 0.6 and equal to or less than 0.8. The total gain calculator 340 may determine a gain of a normalized frequency coefficient included in the intermediate area 520 to correspond to a graph that passes the valley gain 0.001 and the peak gain 1.0.

The pitch enhancer 350 may calculate a new frequency coefficient Xnew[b][k] by multiplying a $k^{th}$ X[b][k] of a $b^{th}$ band by the gain. The new frequency coefficient may be a pitch-enhanced frequency coefficient.

Figure 4:
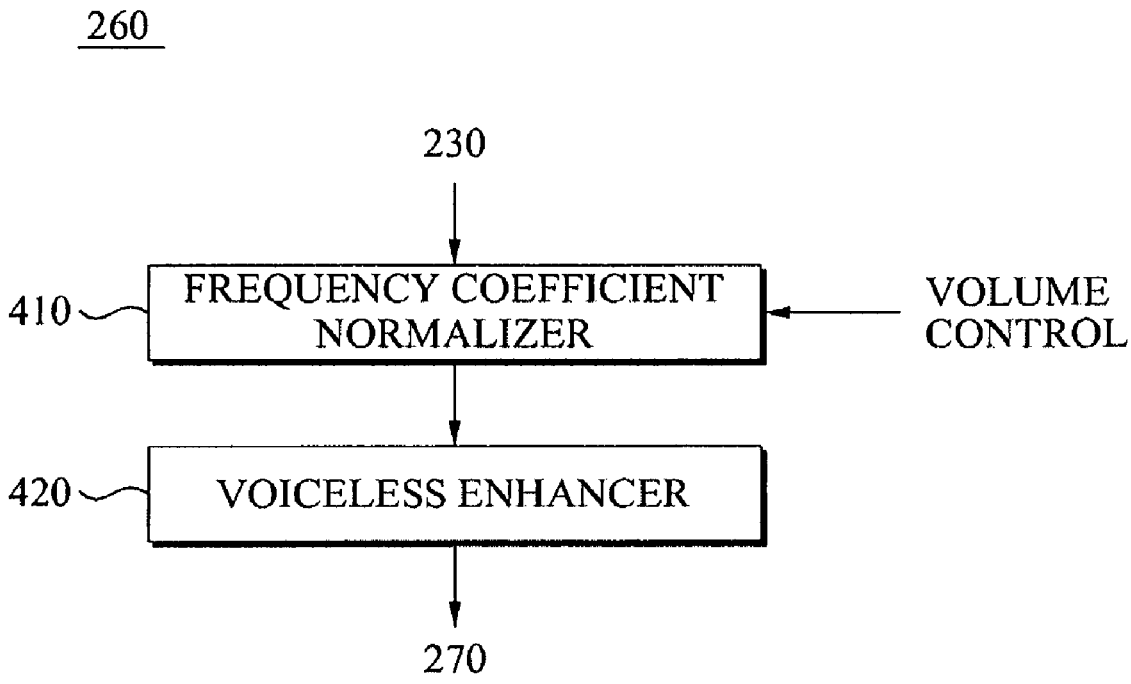
FIG. 4 illustrates an example of a voiceless enhancement unit of FIG. 2.

FIG. 4 illustrates an example of the voiceless enhancement unit 260 of FIG. 2.

Referring to FIG. 4, the voiceless enhancement unit 260 includes a frequency coefficient normalizer 410 and a voiceless enhancer 420.

The frequency coefficient normalizer 410 may set an entire frequency section as a single frequency band, and normalize a frequency coefficient as given in Equation 1. The frequency coefficient normalizer 410 may determine a valley gain, determine a peak gain in response to an inputted volume control signal, and determine a gain with respect to an intermediate area.

The voiceless enhancer 420 may generate a new frequency coefficient by multiplying the frequency coefficient by the gain.

The level normalizer 270 may normalize frequency coefficients, and thus, an energy level of each frequency band after pitch-enhancing and an energy level of each frequency band before pitch-enhancing are the same.

Figure 7:
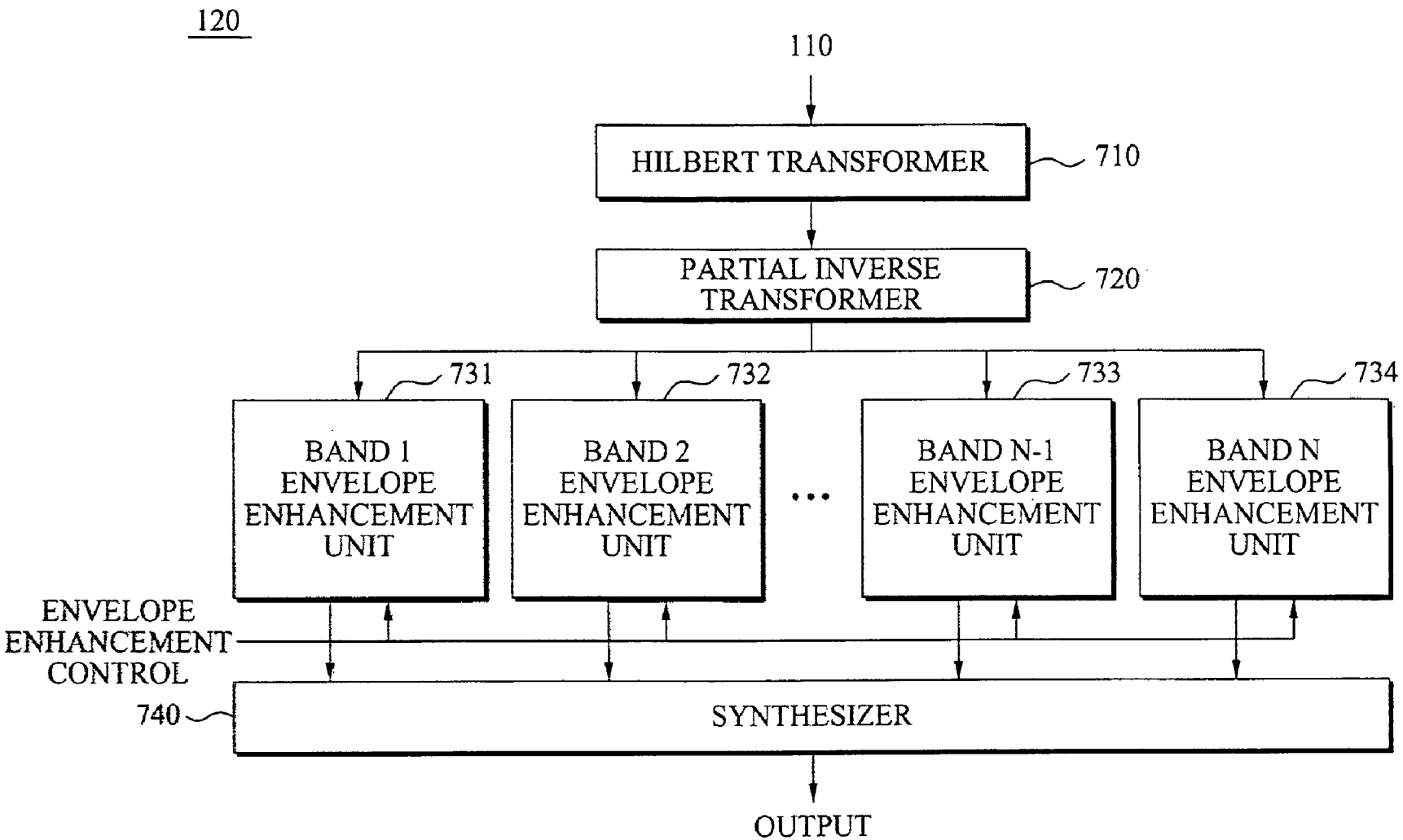
FIG. 7 illustrates an example of a temporal envelope enhancement apparatus of FIG. 1.

FIG. 7 illustrates an example of the temporal envelope enhancement apparatus 120 of FIG. 1. A temporal envelope enhancement apparatus 120 may transform an input audio signal to have an appropriate time/frequency resolution. Specifically, a partial inverse transformer may be applied as illustrated in FIG. 7 and generally a Quadrature Mirror Filter (QMF) may be applied. As the QMF, a complex-valued QMF applied to a Spectral Band Replication (SBR, ISO/IEC 14496-3) may be used.

Referring to FIG. 7, the temporal envelope enhancement apparatus 120 may include a Hilbert transformer 710, a partial inverse transformer 720, N band envelope enhancement units 731 to 734, and a synthesizer 740.

The Hilbert transformer 710 may perform a Hilbert transformation with respect to a pitch-enhanced frequency coefficient Xnew[b][k] to generate $X^H$new[b][k].

The partial inverse transformer 720 may perform inverse transformation with respect to frequency coefficients Xnew [b][k] and $X^H$new[b][k] included in a critical band to generate time domain signals x[c][n] and $x^H$[c][n] respectively corresponding to the critical band. Here, c may be an index of the critical band, which is different from b that is an index of a frequency band and n may be an index of a time frame. Also, c may be one of positive numbers from 1 to N.

A band (1) envelope enhancement unit 731 may perform envelope enhancement processing with respect to a time domain signal corresponding to a first critical band, and a band (2) envelope enhancement unit 732 may perform envelope enhancement processing with respect to a time domain signal corresponding to a second critical band.

A band (N−1) envelope enhancement unit 733 may perform envelope enhancement processing with respect to a time domain signal corresponding to a $(N-1)^{th}$ critical band and a band (N) envelope enhancement unit 734 may perform envelope enhancement processing with respect to a time domain signal corresponding to a $N^{th}$ critical band.

The N band envelope enhancement units 731 to 734 may respectively receive an inputted envelope enhancement control signal and determine a degree of enhancing an envelope.

Figure 8:
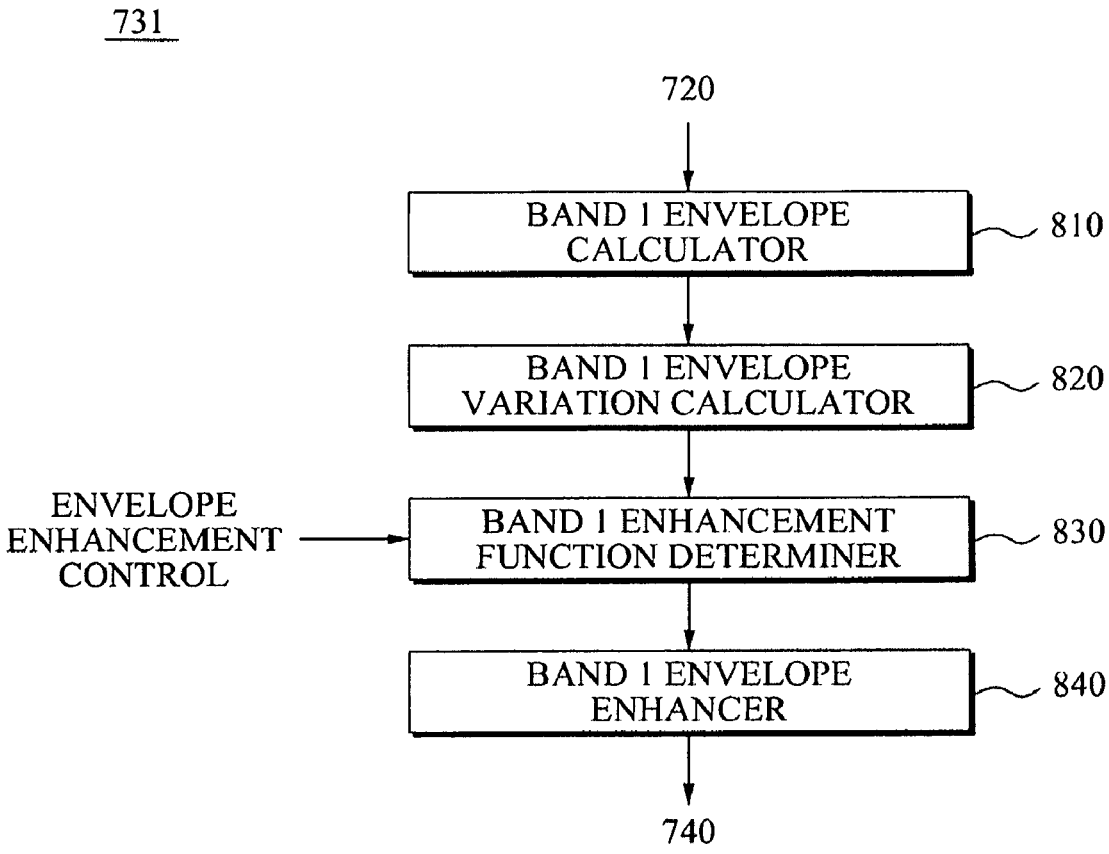
FIG. 8 illustrates an example of a band (1) envelope enhancement unit of FIG. 7.

FIG. 8 illustrates an example of the band (1) envelope enhancement unit 731.

Referring to FIG. 8, the band (1) envelope enhancement unit 731 may include a band (1) envelope calculator 810, a band (1) envelope variation calculator 820, a band (1) enhancement function determiner 830, and a band (1) envelope enhancer 840.

An envelope a [c][n] of a $n^{th}$ time frame corresponding to a $c^{th}$ critical band is calculated as given in Equation 5 below.

$$a[c][n]=\mathrm{sqrt}[(x[c][n])^2+(x^H[c][n])^2] \quad \text{[Equation 5]}$$

The band (1) envelope calculator 810 may calculate an envelope of a signal corresponding to a first critical band through substituting c=1 for Equation 5.

The band (1) envelope variation calculator 820 may calculate an envelope variation in a time domain of a signal corresponding to the first critical band.

Equation 6 given below is an example of calculating of an envelope variation D[c][n] of a $n^{th}$ time frame corresponding to a $c^{th}$ critical band.

$$D[c][n]=(a[c][n])/(a[c][n-1]) \quad \text{[Equation 6]}$$

A band (1) envelope variation calculator 820 may calculate an envelope variation in the first critical band through substituting c=1 for Equation 6.

The band (1) enhancement function determiner 830 may determine an envelope enhancement function $g_1(\ )$ in response to an envelope enhancement control signal. According to an example embodiment, an envelope enhancement function corresponding to $c^{th}$ critical band, $g_c(x)$, may be expressed as $x^p(p\geqq 1.0)$. The band (1) enhancement determiner 830 may determine p in response to the envelope enhancement control signal.

The band (1) envelope enhancer 840 may determine an envelope gain using an envelope enhancement function, and generate a new time domain signal by multiplying the envelope gain by a time domain signal.

An envelope gain in a $n^{th}$ time frame of $c^{th}$ critical band may be given as ($a_{new}$[c][n]/a[c][n]), and a new envelope, $a_{new}$[c][n], may be expressed in Equation 7 below.

$$a_{new}[c][n]=a_{new}[c][n-1]\times g_c(D[c][n]) \quad \text{[Equation 7]}$$

A new domain signal of a $n^{th}$ time frame of $c^{th}$ critical band, Xnew[C][n], may be expressed as Equation 8 below.

$$x_{new}[c][n]=x[c][n]\times(a_{new}[c][n]/a[c][n]) \quad \text{[Equation 8]}$$

Referring again to FIG. 7, the synthesizer 750 may synthesize N critical bands and corresponding time domain signals, $x_{new}$[c][n] ($1\leqq c\leqq N$) to generate output signals.

The temporal envelope enhancement apparatus 120 may enhance a variation of a temporal envelope to reduce an effect of smoothing that may occur when a received voice signal is transmitted. When an envelope of the received voice signal increases, the temporal envelope enhancement apparatus 120 may accelerate increasing of the envelope, and when the envelope of the received voice signal decreases, the temporal envelope enhancement apparatus 120 may accelerate decreasing of the envelope.

The temporal envelope enhancement apparatus 120 may select an enhancement function with respect to each critical band, thereby selecting a degree of enhancing an envelope with respect to each critical band.

The temporal envelope enhancement apparatus 120 may set an exponent p high when a surrounding noise is high.

Figure 9:
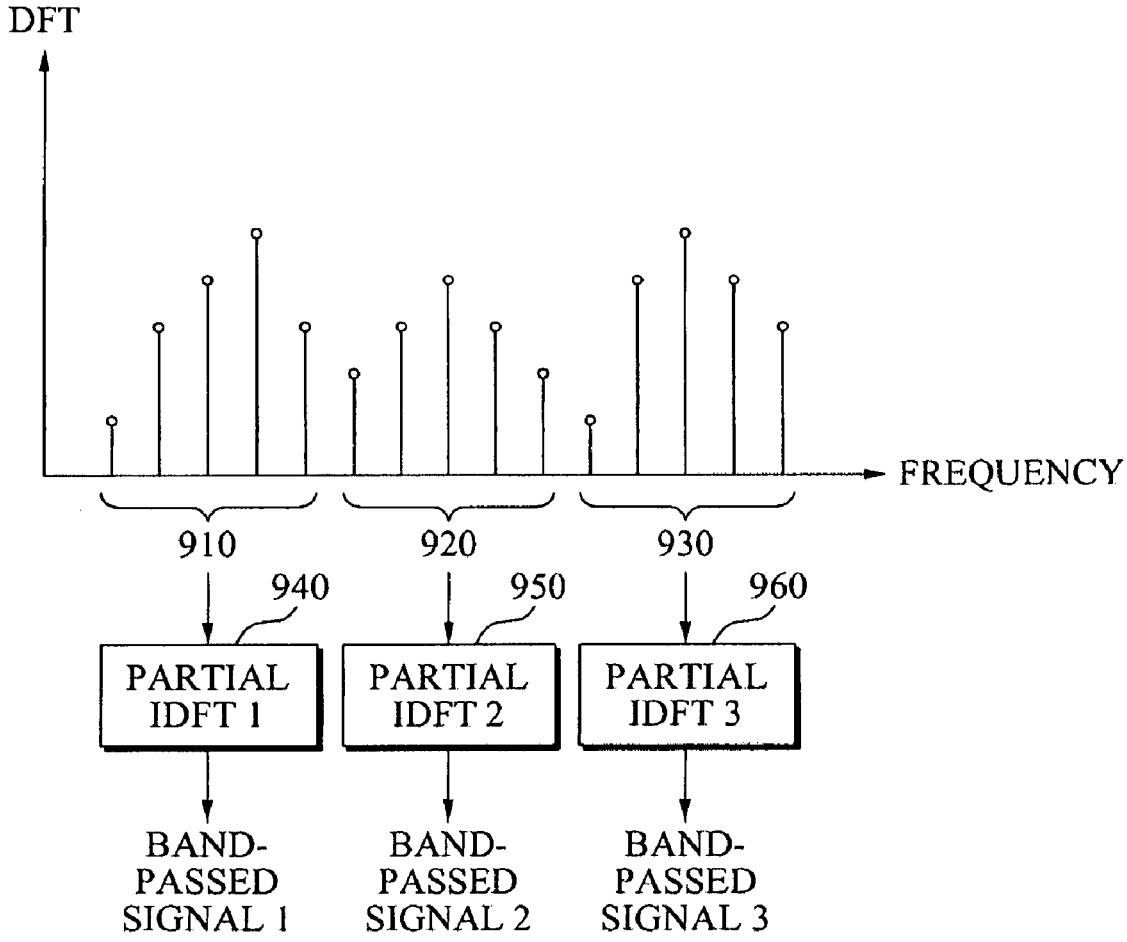
FIG. 9 illustrates an example of an operation of a partial inverse transformer of FIG. 7.

FIG. 9 illustrates an example of an operation of the partial inverse transformer 720 of FIG. 7.

Referring to FIG. 9, a Digital Fourier Transform coefficient according to a frequency is illustrated.

A partial inverse digital Fourier transformer (1) 940 may perform partial Inverse Digital Fourier Transform (IDFT) with respect to frequency coefficients corresponding to a first critical band 910 to generate a band-passed signal (1).

A partial inverse digital Fourier transformer (2) 950 may perform partial IDFT with respect to frequency coefficients corresponding to a second critical band 920 to generate a band-passed signal (2).

A partial inverse digital Fourier transformer (3) 960 may perform partial IDFT with respect to frequency coefficients corresponding to a third critical band 930 to generate a band-passed signal (3).

Since a frequency coefficient corresponding to a different band is zero during an IDFT process in which the partial inverse transformer 720 perform IDFT with respect to frequency coefficients corresponding to a critical band, the partial inverse transformer 720 may shorten a calculating process for the IDFT.

The partial inverse transformer 720 may obtain a higher frequency resolution through the IDFT compared with when obtaining through a band pass filter.

The apparatus 100 may identify a pitch peak and a pitch valley using the high frequency resolution.

Figure 10:
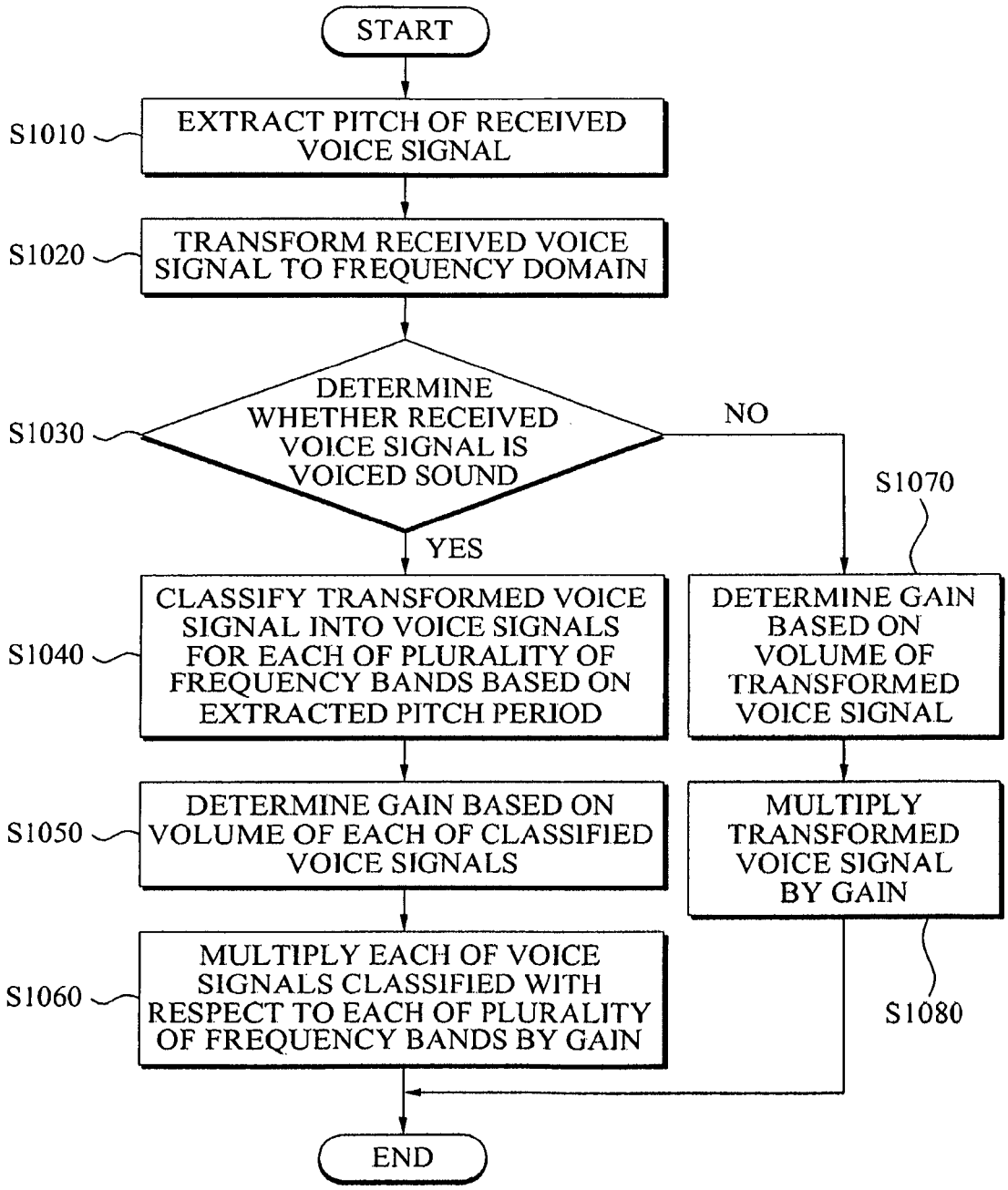
FIG. 10 illustrates a signal quality enhancement method according to another example embodiment.

FIG. 10 illustrates a signal quality enhancement method according to another example embodiment.

Referring to FIG. 10, the signal quality enhancement method extracts a pitch period of a received voice signal in operation S1010.

The signal quality enhancement method transforms the received voice signal to a frequency domain in operation S1020.

The signal quality enhancement method determines whether the received voice signal is a voice sound in operation S1030.

When the received sound signal is the voice sound, the signal quality enhancement method may classify the transformed voice signal into voice signals for each of a plurality of frequency bands based on the extracted pitch period in operation S1040.

The signal quality enhancement method determines a gain based on a volume of each of the classified voice signals in operation S1050.

The signal quality enhancement method multiplies the voice signal classified with respect to each of the plurality of frequency bands by the gain determined in operation S1050 in operation S1060.

When the received voice signal is not the voice sound, the signal quality enhancement method determines a gain based on a volume of the transformed voice signal in operation S1070.

The signal quality enhancement method multiplies the transformed voice signal by the gain determined in operation S1070 in operation S1080.

Although FIG. 10 illustrates an example embodiment of receiving and processing the voice signal, the signal quality enhancement method may process a music signal or a sound effect signal as well as the voice signal to enhance quality of an audio signal according to an example embodiment. Also, according to an example embodiment, the signal quality enhancement method may receive the audio signal, and also read an audio file stored in an mp3 player or a storing apparatus and process an audio signal inputted from the read file.

According to an example embodiment, the signal qualify enhancement method may process the music signal and the sound effect signal which is not a human voice signal. In this instance, in operation S1030, whether the audio signal has a pitch is determined based on the pitch of the audio signal extracted in operation S1010. When the audio signal has the pitch, the signal quality enhancement method may process the audio signal in the same manner as processing the voice sound signal.

Figure 11:
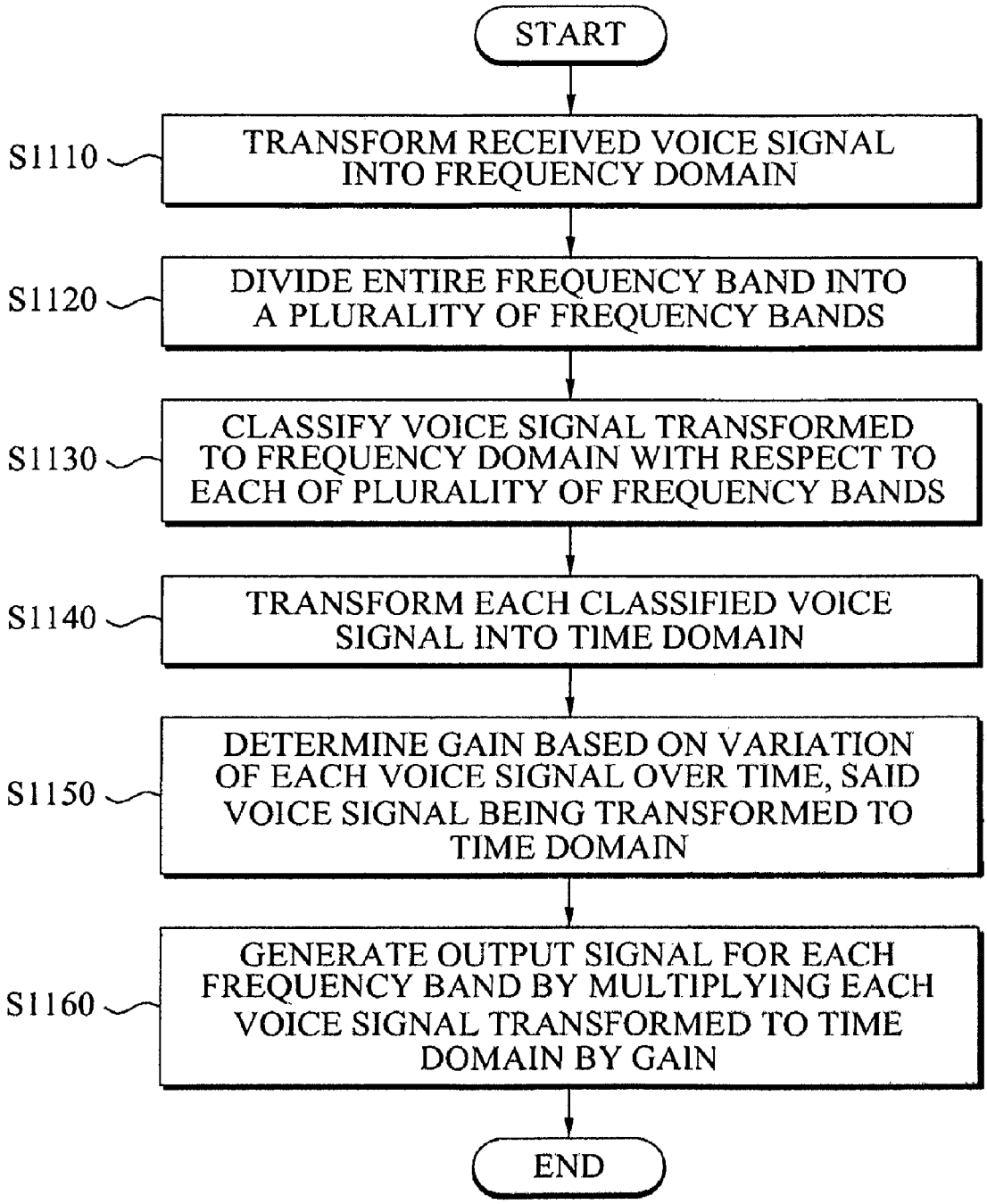
FIG. 11 illustrates a signal quality enhancement method according to still another example embodiment.

FIG. 11 illustrates a signal quality enhancement method according to still another example embodiment.

Referring to FIG. 11, the signal quality enhancement method transforms a received voice signal into a frequency domain in operation S1110.

The signal quality enhancement method divides an entire frequency band into a plurality of frequency bands in operation S1120.

The signal quality enhancement method classifies the voice signal transformed to the frequency domain with respect to each of the plurality of frequency bands in operation S1130.

The signal quality enhancement method transforms each of the classified voice signals into a time domain in operation S1140.

The signal quality enhancement method determines a gain based on a variation of each voice signal over time, the voice signal being transformed to the time domain in operation S1150.

The signal quality enhancement method generates an output signal for each frequency band by multiplying each voice signal transformed to the time domain by the gain in operation S1160.

Although FIG. 11 illustrates an example embodiment of receiving and processing the voice signal, the signal quality enhancement method may process a music signal or a sound effect signal as well as the voice signal to enhance quality of an audio signal according to an example embodiment. Also, according to an example embodiment, the signal quality enhancement method may not only receive the audio signal, but also read an audio file stored in an mp3 player or a storing apparatus and process an audio signal inputted from the read file.

Figure 12:
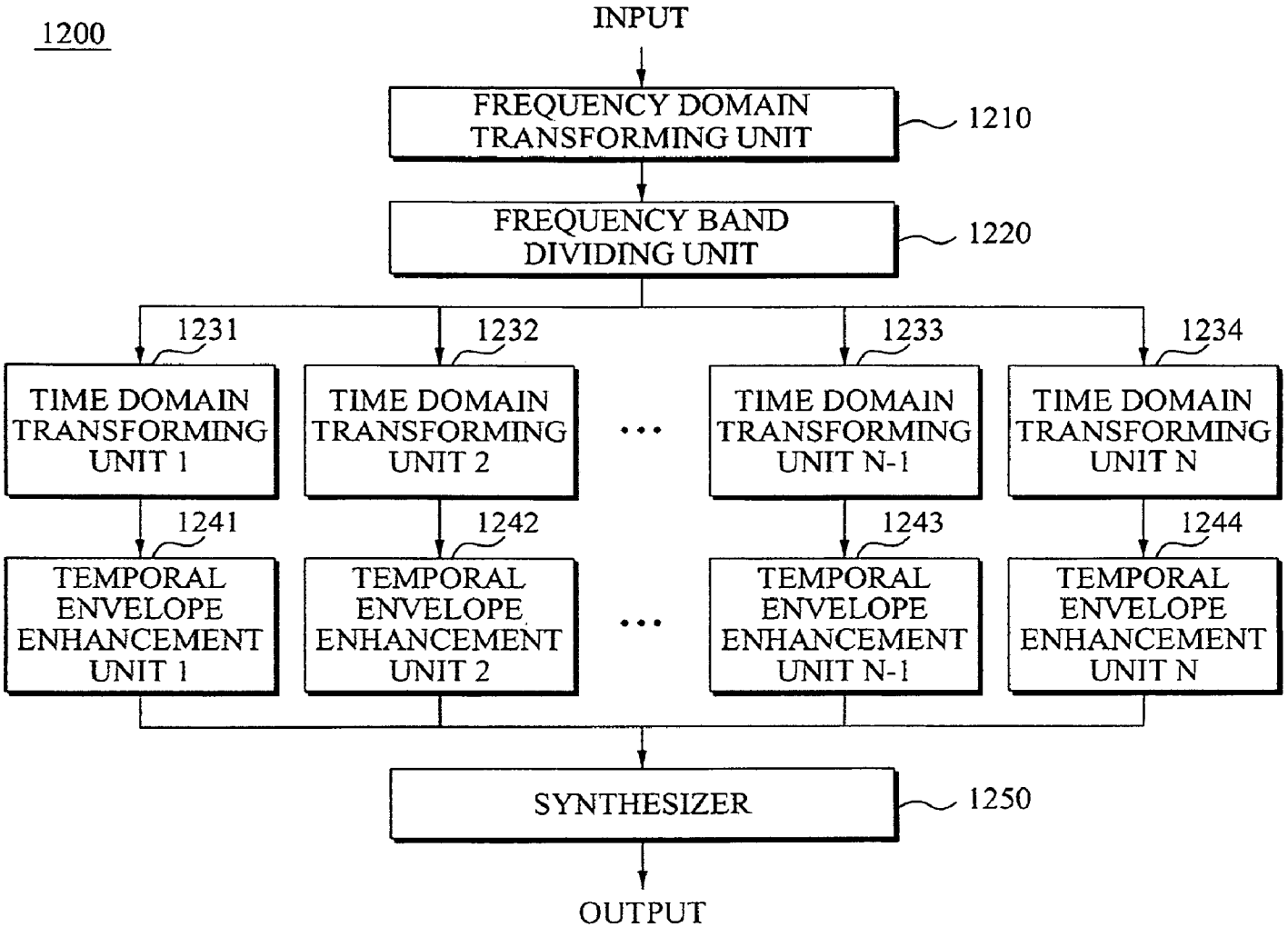
FIG. 12 illustrates an apparatus according to another example embodiment.

FIG. 12 illustrates an apparatus 1200 according to another example embodiment.

Referring to FIG. 12, an apparatus 1200 may include a frequency domain transforming unit 1210, a frequency band dividing unit 1220, N time domain transforming units 1231 to 1234, N temporal envelope enhancement units 1241 to 1244, and a synthesizer 1250. The apparatus 1200 may receive an audio signal and enhance a temporal envelope of the audio signal.

The frequency domain transforming unit 1210 transforms the audio signal into a frequency domain.

The frequency band dividing unit 1220 may divide an entire frequency band into a plurality of frequency bands. The frequency band dividing unit 1220 may classify the audio signal transformed to the frequency domain into audio signals for each of the plurality of frequency bands.

The time domain transforming unit (1) 1231 may transform an audio signal corresponding to a first band into a time domain. The temporal envelope enhancement unit (1) 1241 may determine a gain based on a variation of the audio signal transformed into the time domain, the audio signal corresponding to the first band. The temporal envelope enhancement (1) 1241 may generate an output signal of the first band by multiplying the audio signal transformed into the time domain by the gain, the audio signal corresponding to the first band.

In the same manner, the time domain transforming unit (2) 1232 may transform an audio signal corresponding to a second band into a time domain. The temporal envelope enhancement (2) 1242 may determine a gain based on a variation of the audio signal transformed into the time domain, the audio signal corresponding to the second band. The temporal envelope enhancement (2) 1242 may generate an output signal of the second band by multiplying the audio signal transformed into the time domain by the gain, the audio signal corresponding to the second band.

In the same manner, the time domain transforming unit (N) 1234 may transform an audio signal corresponding to an $N^{th}$ band into a time domain. The temporal enhancement (N) 1244 may determine a gain based on a variation of the audio signal transformed into the time domain, the audio signal corresponding to the $N^{th}$ band. The temporal envelope enhancement (N) 1244 may generate an output signal of the $N^{th}$ band by multiplying the audio signal transformed into the time domain by the gain, the audio signal corresponding to the $N^{th}$ band.

The synthesizer 1250 may synthesize output signals of the first band through the $N^{th}$ band and generate an output signal.

Figure 13:
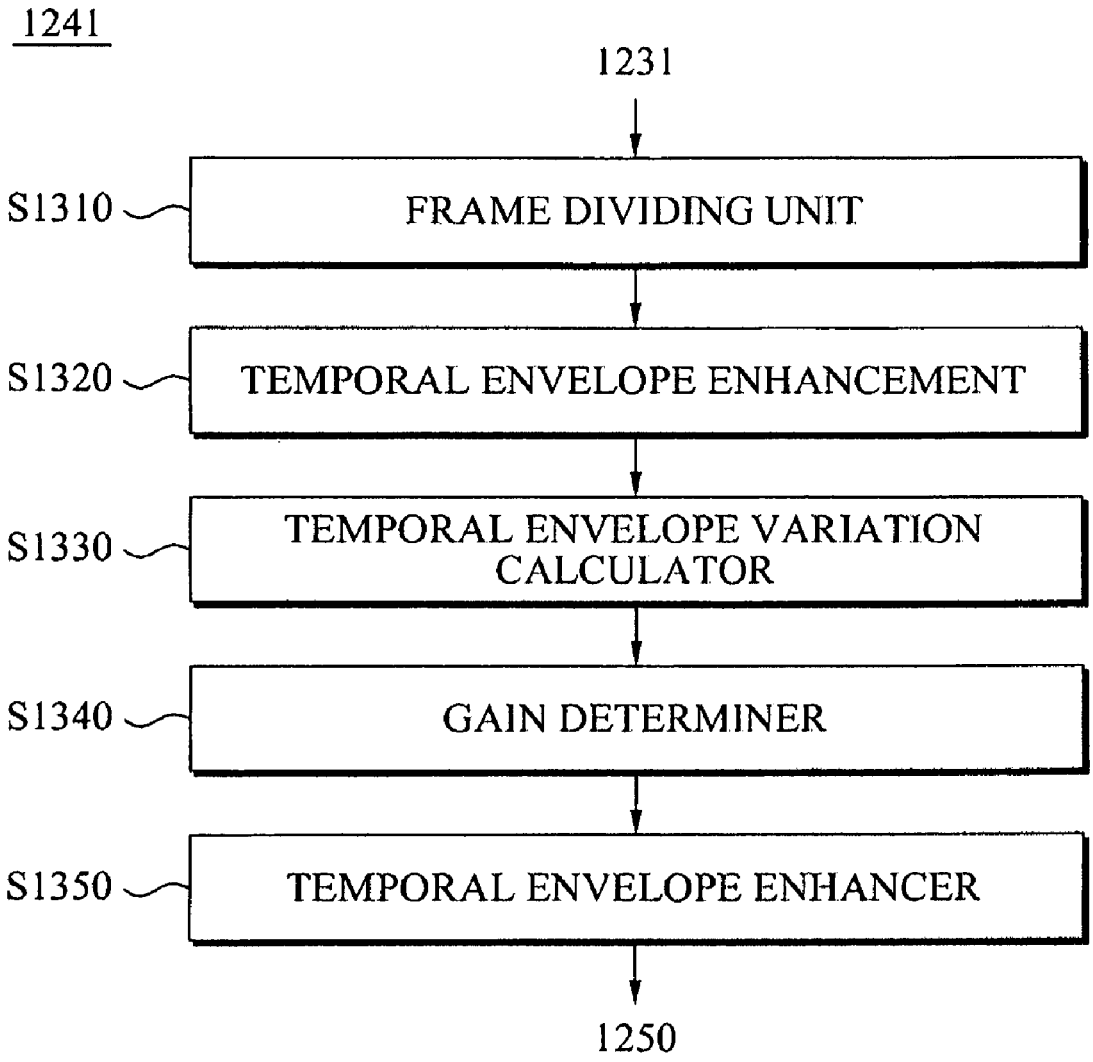
FIG. 13 illustrates an example of a temporal envelope enhancement (1) of FIG. 12.

FIG. 13 illustrates an example of the temporal envelope enhancement (1) 1241 of FIG. 12.

Referring to FIG. 13, the temporal envelope enhancement (1) 1241 may include a frame dividing unit 1310, a temporal envelope calculator 1320, a temporal envelope variation calculator 1330, a gain determiner 1340, and a temporal envelope enhancer 1350.

The frame dividing unit 1310 may divide an audio signal transformed to a temporal domain according to a plurality of time frames, the audio signal corresponding to a first band.

The temporal envelope calculator 1320 may calculate a temporal envelope of each of the audio signals, the audio signals being a result of the dividing of the transformed audio signal according to the plurality of time frames. The temporal envelope calculator 1320 may calculate the temporal envelope using a Hilbert transform.

The temporal envelope variation calculator 1330 may calculate a variation of the temporal envelope based on a ratio of a temporal envelope of an audio signal corresponding to a following frame to a temporal envelope of an audio signal corresponding to a previous frame.

The gain determiner 1340 may determine a gain based on the variation of the temporal envelope and an input. The gain determiner 1340 may determine gains respectively for a frequency band and time frame.

The temporal envelope enhancer 1350 may generate output signals respectively corresponding to the frequency band and the time frame by multiplying each of the audio signals by the gain, the audio signals being a result of the dividing of the transformed audio signal according to the plurality of time frames.

The temporal enhancement unit (1) 1241 may synthesize output signals respectively corresponding to each time frame and generate an output signal corresponding to the first band.

Although the temporal envelope enhancement unit (1) 1241 is only described for convenience of description, the temporal envelope enhancement unit (2) 1242, the temporal envelope enhancement unit (3) 1243, and the temporal envelope enhancement unit (N) 1244 may be applied in the same manner.

According to example embodiments, an intelligibility of voice communication may increase even under a circumstance where a surrounding noise is relatively higher. According to example embodiments, the intelligibility of the voice communication may increase through performing a signal processing in a time domain together with a signal processing of a frequency domain.

According to example embodiments, the intelligibility of the voice communication may be adaptively improved according to a volume control. According to example embodiments, an output signal with optimized quality may be provided according to the volume control. Also, the output signal may maintain a regular quality level even when the volume control signal inputted is changed.

The signal quality enhancement method according to the above-described example embodiments may be recorded in computer-readable media including program instructions to implement various operations embodied by a computer. The media may also include, alone or in combination with the program instructions, data files, data structures, and the like. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described example embodiments, or vice versa. The computer-readable media may include computer-readable codes as a program to perform the above-described method in the above-described apparatuses. The computer-readable codes of the computer-readable medium may be transmitted, for example, through carrier waves, a wired or wireless network, or the Internet.

Although a few example embodiments have been shown and described, the present disclosure is not limited to the described example embodiments. Instead, it would be appreciated by those skilled in the art that changes may be made to these example embodiments without departing from the principles and spirit of the disclosure, the scope of which is defined by the claims and their equivalents.

What is claimed is:

1. An apparatus comprising:

a pitch calculating unit to extract a pitch period of an audio signal;

a frequency domain transforming unit to transform the audio signal to a frequency domain;

a frequency band dividing unit to divide an entire frequency band into a plurality of frequency bands based on the extracted pitch period, and to classify the transformed audio signal into audio signals for each of the plurality of frequency bands;

a pitch enhancement unit to determine a gain based on a volume of the transformed audio signal, and to generate an output signal by multiplying each of the classified audio signals with respect to each of the plurality of frequency bands by the gain, the pitch enhancement unit dividing each of the classified audio signals into a pitch peak area, an intermediate area, and a pitch valley area based on the volume of the classified audio signal, and determining the gain according to each area; and a processor to control at least one of the pitch calculating unit, the frequency domain transforming unit, the frequency band dividing unit, and the pitch enhancement unit.

2. The apparatus of claim 1, wherein the pitch enhancement unit determines the gain decrease as the volume of the classified audio signal decreases.

3. The apparatus of claim 1, further comprising:

a voice sound determining unit to determine whether the audio signal is a voice sound or a voiceless sound and to classify the transformed audio signal into a voice sound signal according to whether the transformed audio signal is a voice sound signal, wherein the frequency band dividing unit classifies the classified voice sound signal into voice sound signals for each of the plurality of frequency bands.

4. The apparatus of claim 1, wherein the pitch enhancement unit adjusts the gain with respect to each of the plurality of frequency bands.

5. An apparatus comprising:

a pitch calculating unit to extract a pitch period of an audio signal;

a frequency domain transforming unit to transform the audio signal to a frequency domain;

a frequency band dividing unit to divide an entire frequency band into a plurality of frequency bands based on the extracted pitch period, and to classify the transformed audio signal into audio signals for each of the plurality of frequency bands;

a pitch enhancement unit to determine a gain based on a volume of the transformed audio signal, and to generate an output signal by multiplying each of the classified audio signals with respect to each of the plurality of frequency bands by the gain, the pitch enhancement unit adjusting the gain to decrease a ratio of a maximum gain to a minimum gain as a frequency of each of the plurality of frequency band increases; and a processor to control at least one of the pitch calculating unit, the frequency domain transforming unit, the frequency band dividing unit, and the pitch enhancement unit.

6. The apparatus of claim 1, wherein the pitch enhancement unit adjusts the gain based on a volume control signal of an inputted output signal.

7. The apparatus of claim 1, wherein the pitch enhancement calculates a maximum value and minimum value of each of the classified audio signals with respect to each of the plurality of frequency bands, normalizes the transformed audio signal based on the maximum value and minimum value, and generates the output signal by multiplying the normalized audio signal by the gain.

8. An apparatus comprising:

a frequency domain transforming unit to transform an audio signal to a frequency domain;

a frequency band dividing unit to classify the transformed audio signal into audio signals for each of a plurality of frequency bands;

a time domain transforming unit to transform each of the classified audio signals into a time domain;

a temporal envelope enhancement unit to determine a gain based on a variation of the audio signal over time, the audio signal being transformed to the time domain, and to generate an output signal for each of the plurality of frequency bands by multiplying the audio signal transformed into the time domain by the gain;

a frame dividing unit to divide the audio signal transformed to the time domain, according to a plurality of time frames, the temporal envelope enhancement unit determining the gain based on a ratio of an audio signal included in a following frame to an audio signal included in a previous frame; and a processor to control at least one of the frequency domain transforming unit, the frequency band dividing unit, the time domain transforming unit, and the temporal envelope enhancement unit.

9. The apparatus of claim 8, wherein the temporal envelope enhancement unit determines the gain to increase as the variation of the audio signal over time increases, the audio signal being transformed to the time domain.

10. The apparatus of claim 8, wherein the temporal envelope enhancement adjusts the gain based on an inputted enhancement control signal.

11. The apparatus of claim 8, wherein the temporal envelope enhancement unit adjusts the gain with respect to each of the plurality of frequency bands.

12. The apparatus of claim 8, wherein the frequency domain transforming unit transforms the audio signal to a frequency domain using a Digital Fourier Transform (DFT), and the time domain transforming unit transforms each of the classified audio signals into the time domain using an Inverse Digital Fourier Transform (IDFT).

13. An apparatus comprising:

a pitch band dividing unit to calculate a pitch period of an audio signal and to classify a frequency domain signal of the audio signal based on the pitch period;

a pitch enhancement unit to determine a gain based on a volume of the classified frequency domain signal, and to generate a pitch enhancement signal by multiplying the frequency domain signal by the gain; and a temporal envelope enhancement unit to determine a gain for each time based on a variation of the generated pitch enhancement signal over time, and to generate an output signal by multiplying the generated pitch enhancement signal by the gain for each time, the determining the gain comprising adjusting the gain to decrease a ratio of a maximum gain to a minimum gain as frequency of each of the plurality of frequency bands increases; and a processor to control at least one of the pitch band dividing unit, the pitch enhancement unit, and the temporal envelope enhancement unit.

14. A signal quality enhancement method, the method comprising:

extracting a pitch period of an audio signal;

transforming the audio signal to a frequency domain;

classifying the transformed audio signal into audio signals for each of a plurality of frequency bands;

determining a gain, by a processor, based on a volume of each of the classified audio signals; and generating an output signal by multiplying each of the audio signals classified with respect to each of the plurality of frequency bands by the gain, the determining the gain comprising dividing each of the classified audio signals into a pitch peak area, an intermediate area, and a pitch valley area based on the volume of the classified audio signal, and determining the gain according to each area.

15. The method of claim 14, further comprising:

determining whether the audio signal is voice sound or voiceless sound; and classifying the transformed audio signal into a voice sound signal according to whether the transformed audio signal is a voice sound signal, wherein the classifying of the audio signal classifies the classified voice sound signal into voice sound signals for each of the plurality of frequency bands.

16. A signal quality enhancement method, the method comprising:

extracting a pitch period of an audio signal;

transforming the audio signal to a frequency domain;

classifying the transformed audio signal into audio signals for each of a plurality of frequency bands;

determining a gain, by a processor, based on a volume of each of the classified audio signals; and generating an output signal by multiplying each of the audio signals classified with respect to each of the plurality of frequency bands by the gain, the determining the gain comprising adjusting the gain to decrease a ratio of a maximum gain to a minimum gain as frequency of each of the plurality of frequency bands increases.

17. The method of claim 14, wherein the determining of the gain comprises adjusting the gain based on a volume control signal of an inputted output signal.

18. A signal quality enhancement method, the method comprising:

transforming an audio signal to a frequency domain;

classifying the audio signal transformed to the frequency domain into audio signals for each of a plurality of frequency bands;

transforming each of the classified audio signals into a time domain;

determining a gain, by a processor, based on variation of the audio signal over time, the audio signal being transformed into the time domain;

generating an output signal for each frequency band by multiplying the audio signal transformed into the time domain by the gain; and dividing the audio signal transformed to the time domain, according to a plurality of time frames wherein the determining of the gain comprises determining the gain based on a ratio of an audio signal included in a following frame to an audio signal included in a previous frame.

19. The method of claim 18, wherein the determining of the gain comprises determining the gain to increase as the variation of the audio signal over time increases, the audio signal being transformed to the time domain.

20. The method of claim 18, wherein the determining of the gain comprises adjusting the gain based on an inputted enhancement control signal.

21. An apparatus comprising:

a transforming unit to perform a Quadrature Mirror Filter (QMF) analysis to express an audio signal as a time/frequency domain;

a temporal envelope enhancement unit to determine a gain based on variation of an audio signal over time, the audio signal being transformed into the time domain, and to generate an output signal for each frequency band by multiplying the audio signal transformed into the time domain by the gain;

a frame dividing unit to divide the audio signal transformed to the time domain, according to a plurality of time frames, the temporal envelope enhancement unit determining the gain based on a ratio of an audio signal included in a following frame to an audio signal included in a previous frame; and a processor to control at least one of the transforming unit, the temporal envelope enhancement unit, and the frame dividing unit.

* * * * *

UNITED STATES PATENT AND TRADEMARK OFFICE

CERTIFICATE OF CORRECTION

PATENT NO. : 8,315,862 B2
APPLICATION NO. : 12/479009
DATED : November 20, 2012
INVENTOR(S) : Kim et al.

It is certified that error appears in the above-identified patent and that said Letters Patent is hereby corrected as shown below:

On the Title Page, item (73) should read

(73) Assignee: Samsung Electronics Co., Ltd., Suwon-si (KR) and

Kwangwoon University Industry - Academic Collaboration Foundation; Seoul (KR)

Signed and Sealed this
Sixteenth Day of September, 2014

Michelle K. Lee

Michelle K. Lee
*Deputy Director of the United States Patent and Trademark Office*